United States Patent [19]

Stratton

[11] 4,449,333

[45] May 22, 1984

[54] VALLEY STRIP FOR ROOF STRUCTURE

[76] Inventor: David G. Stratton, 1301 16th St., Plano, Tex. 75074

[21] Appl. No.: 389,761

[22] Filed: Jun. 18, 1982

[51] Int. Cl.[3] ..... E04D 1/36

[52] U.S. Cl. ..... 52/13; 52/276; 52/514; 52/94

[58] Field of Search ..... 52/13, 276, 277, 278, 52/14, 528, 556, 94, 96, 94.5; 72/375, 335; 29/514, 521, 243.5

[56] References Cited

U.S. PATENT DOCUMENTS

| | | | |
|---|---|---|---|
| 313,852 | 3/1885 | Cortright | 52/13 |
| 364,044 | 5/1887 | Sagendorph | 52/278 |
| 443,322 | 12/1890 | Kinnear | 52/94 |
| 1,963,583 | 6/1934 | Jenkins | 52/277 |
| 2,212,269 | 8/1940 | Kohler | 428/603 |

*Primary Examiner*—James L. Ridgill, Jr.

*Attorney, Agent, or Firm*—Hubbard, Thurman, Turner & Tucker

[57] ABSTRACT

A valley strip for conducting runoff from the line of intersection of two intersecting roof surfaces of pitched roof comprises an elongated sheet member having a defined channel portion with a bottom wall and opposed vertically extending sidewalls formed between opposed flanges. The recessed channel portion can handle larger precipitation runoff flows, minimizes runoff from one surface flowing over the strip flange underlying the opposite roof surface, and provides for placing the bottom wall of the valley strip in supportive relationship by the underlying roof structure.

6 Claims, 6 Drawing Figures

FIG. 1
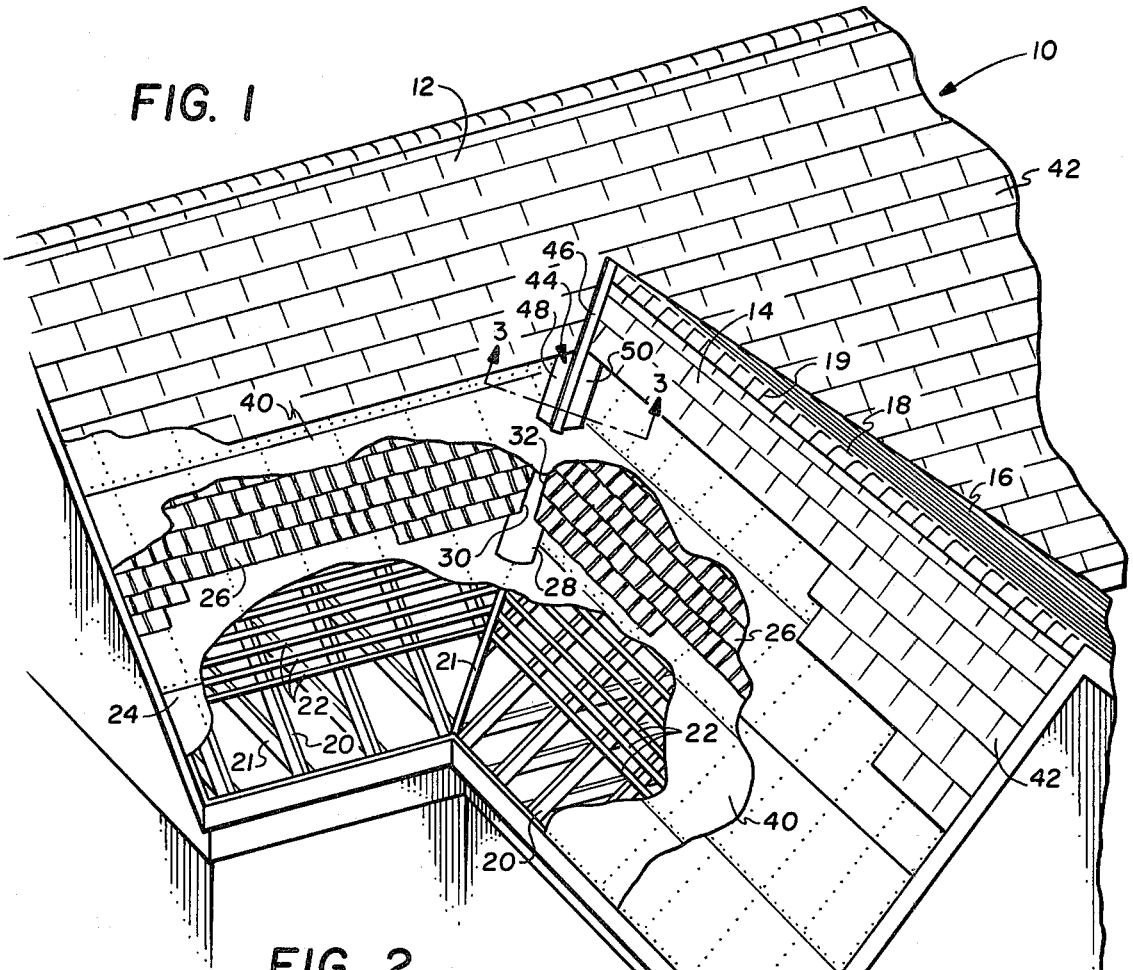
FIG. 2
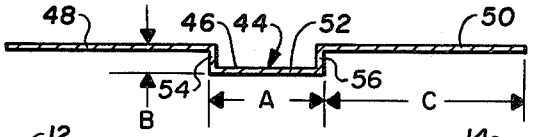
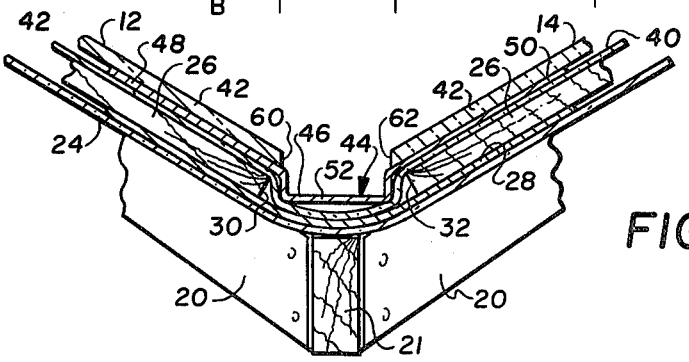
FIG. 3
FIG. 4
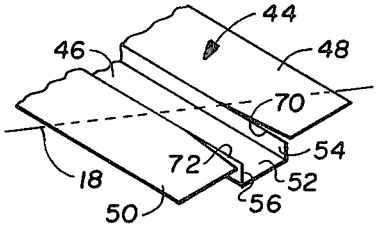
FIG. 5
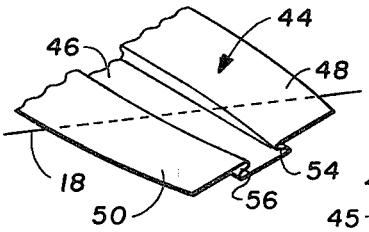
FIG. 6
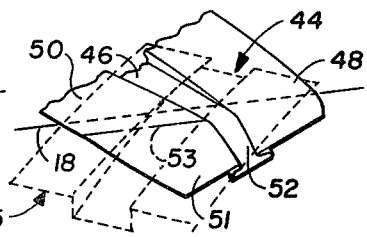

VALLEY STRIP FOR ROOF STRUCTURE

BACKGROUND OF THE INVENTION

1. Field of the Invention

This invention pertains to an elongated roof valley strip having a channel shaped cross-section and opposed flanges for conducting precipitation runoff of sloping roof surfaces.

2. Background Art

In conventional sloping roof construction the intersection of two sloping roof surfaces is normally covered by an elongated sheet member forming a covering for the roof surface intersection and also forming a trough for conducting precipitation runoff from the intersecting roof surfaces. Conventional roof valley strips are formed from relatively thin sheet metal or the like and are merely bent or deflected during the laying of the roof to form a relatively shallow concave curved surface with opposed flanges of the strip lying under the roof shingles. One disadvantage with conventional roof valley strip arrangements is that during periods of heavy rainwater runoff, for example, the flow of water down one roof surface will be of such velocity and momentum as to run into the trough portion of the strip, over the opposing strip flange and under the edge of the roof covering. This runoff may be of sufficient velocity to run to the edge of the flange portion and thereby leak into the interior of the building or at least result in leakage to the subroofing surface which can result in eventual damage to the roof from trapped moisture.

Another problem with conventional valley strips is in the repair or covering of roofs having a first roof covering such as, for example, wood shingles, which are of substantial thickness. In the use of a conventional valley strip to overlie the previous shingle layer, a substantial gap is formed between the original valley strip and the overlying new valley strip which, if walked on or otherwise impinged on, may damage the overlying valley strip or at least cause bending and deformation of the valley strip. In the former case, if the new valley strip is punctured, precipitation runoff will, of course, run under the new valley and may result in damage to the roof or leakage therethrough. In the latter instance, the bending or deformation of the unsupported trough portion of the new valley strip will mar the appearance of the roof. Moreover, if the valleys are formed of conventional galvanized sheet steel any bending or deflection of the valley strip tends to break the protective coating resulting in early onset of corrosion of the base metal.

The abovementioned problems, which are particularly acute in recovering roofs having an underlying or first surface of shingles of substantial thickness, have been overcome with the improved valley strip construction of the present invention which is adapted to minimize the chance of leakage of precipitation runoff through the roof structure by redirecting the runoff flow in a more positive manner to prevent migration of the runoff water over the opposed flange surfaces of the strip. Moreover, the improved valley strip construction of the present invention forms a trough portion which has a bottom surface which is recessed to minimize contact by a person walking on the roof and to place the bottom surface of the valley trough closely adjacent to the underlying roof covering whereby adequate support of the valley strip is provided.

SUMMARY OF THE INVENTION

The present invention provides an improved valley strip for use in new and resurfaced roof structures having a channel shaped cross-section with opposed flanges wherein the flanges are adapted to underlie a roof covering and wherein the channel shaped cross-section improves the runoff flow handling capability of the valley strip and to minimize the chance of water running over the valley flanges and leaking into the underlying roof covering or the structure covered by the roof.

The present invention is particularly adapted for use in placing secondary roof coverings over an initial roof covering wherein the initial covering is a relatively thick material such as wood shingles or the like. Although the valley strip of the present invention is particularly adapted for resurfacing or repairing roof structures, it may also be used with new roof construction to provide the advantages inherent in its inventive construction and application. Those skilled in the art will recognize the superior features of the invention upon reading the detailed description which follows in conjunction with the drawings.

BRIEF DESCRIPTION OF THE DRAWING

FIG. 1 is a perspective view of a typical pitched roof structure including the valley strip of the present invention;

FIG. 2 is a transverse cross-sectional view of the valley strip of the present invention in its as formed condition;

FIG. 3 is a cross-section view taken generally along the line 3—3 of FIG. 1; and FIGS. 4, 5 and 6 are sequential perspective views illustrating forming the upper end of the valley strip to overlie the ridge line of two intersecting roof surfaces.

DESCRIPTION OF THE PREFERRED EMBODIMENT

In the description which follows, like parts are marked throughout the specification and drawings with the same reference numerals, respectively. The drawing figures are not necessarily to scale and certain features of the structure disclosed in the drawings may be exaggerated in scale to better illustrate the inventive concept.

Referring to FIG. 1, there is illustrated a portion of a building such as a residential house, generally designated by the numeral 10. The house 10 is provided with a pitched roof having a plurality of roof surfaces 12, 14, and 16, illustrated. The roof surfaces 12 and 14 are sloped and intersect along a line forming an angle with the horizon. The roof surfaces 12 and 16 also intersect along a similar line which intersects with the line of intersection of the surfaces 12 and 14. The roof surfaces 14 and 16 intersect along a generally horizontal ridge line, designated by the numeral 18 in FIG. 1.

The construction of the roof for the house 10 is typical in that the sloping surfaces are supported by spaced apart inclined rafters 20. The rafters 20 are secured to each other by horizontal and angled tie beams 21 in accordance with conventional practice. The rafters 20 are covered with a plurality of horizontally extending spaced apart lathing or stringers 22 serving as means for supporting and securing a roof covering. The roof covering overlying the stringers 22 may include a layer of heavy felt or asphalt composition paper, designated by the numeral 24, and then a layer of shingles designated by the numeral 26. Alternatively, the shingles 26 may be nailed directly to the stringers 22. In conventional house construction found throughout the southwestern part of the United States, the shingles 26 are nailed directly to the stringers 22 and typically comprise a tapered shingle cut from wood such as cedar or the like. The bottom end of the shingles may typically have a thickness on the order of ¼ to ⅝ inches. The intersection of the sloping surfaces 12 and 14 is normally provided with a covering comprising an elongated sheet metal strip commonly referred to as a valley and designated by the numeral 28 in FIG. 1. The valley 28 is a relatively thin sheet metal strip which is bent in a shallow concave cross-sectional shape and is of a width sufficient that opposed edges of the valley strip lie under the shingles of the intersecting roof surfaces 12 and 14. Accordingly, a surface portion is formed between opposed edges 30 and 32 of the respective roof surfaces 12 and 14, as illustrated, for conducting precipitation runoff from the roof. However, one problem that has been realized with the use of conventional valley strip construction, as illustrated in FIGS. 1 and 3, is that, for example, heavy precipitation runoff from the roof surface 14 may flow across the valley strip 28 from the edge 32 and under the edge 30 of the shingles 26 of the roof surface 12 with sufficient force to leak under the shingles to the covering 24. Of course, absent the covering 24, the aforedescribed water flow would leak into the interior of the house 10. Naturally, heavy precipitation runoff from the surface 12 will also tend to run under the edge 32 of the shingles 26 on the surface 14 which cover the opposite edge of the valley strip 28 resulting in leakage from that side of the valley strip also.

The present invention has been developed pursuant to problems with conventional valley strips as described hereinabove and also pursuant to problems associated with providing valley strips when recovering a roof, such as the roof of the house 10, with a secondary covering of, for example, asphalt composition shingles of a relatively heavy construction, such as a shingle made under the brand name TIMBERLINE. In seeking a solution to the aforementioned leakage problem and also in realizing the problems associated with recovering a roof having a first covering of relatively thick shingles, I have discovered an improved valley strip construction which is particularly advantageous for repairing or recovering previously covered roofs but which also may be used in new roof construction.

The house 10, illustrated in FIG. 1, is covered with a secondary roof covering which comprises a layer of flat felt or asphalt composition paper, designated by the numeral 40, and similar to the covering 24. The secondary covering of the roof structure illustrated in FIG. 1 also includes a covering of wood or simulated wood shingles or the like, also known as composition type shingles, and designated by the numeral 42. In a preferred method of recovering a roof as illustrated in FIG. 1, the covering material 40 is laid over the surface of the shingle covering 26 and an improved valley strip in accordance with the present invention is placed at the intersection of the roof surfaces 12 and 14 as well as at the intersection of the surfaces 12 and 16.

The improved valley strip of the present invention is designated by the numeral 44 in FIG. 1 and is characterized by an elongated relatively thin sheet member which is formed to have a defined channel portion 46, see FIGS. 2 and 3 also, and a pair of opposed longitudinally extending flanges 48 and 50. Referring also to FIG. 2, which is a transverse cross-section of the valley strip 44, the channel portion 46 includes a bottom wall 52 and opposed sidewalls 54 and 56. The channel portion 46 is preferably formed integral with the flanges 48 and 50 from a continuous elongated strip of galvanized sheet steel, for example. In fact, the valley strip 44 may be formed using conventional commercially available valley strip such as the valley strip 28 illustrated. I have discovered that a suitable flange width of the flanges 48 and 50 may be retained while providing yet a suitable width and depth of the channel portion 46 by making the width, dimension A in FIG. 2, approximately 4 inches, and making the depth, dimension B, approximately ½ to 1 inch, thereby leaving a flange width on both sides, dimension C, 6½ to 7 inches.

The vertically upstanding sidewalls 54 and 56 of the channel portion 46 have been discovered to be suitable to substantially prevent precipitation runoff from the opposing roof surfaces running up under the roof covering of the opposite roof surface and over the flange of the valley strip to the extent that it will flow over the outer edge of the flange and thereby leak onto the roof covering under the valley strip or possibly directly into the interior of the building covered by the roof. Moreover, as will be noted viewing FIG. 3, the bottom wall 52 of the channel portion 46 is recessed from the roof surface sufficiently and the channel width is such that a person walking on the roof surface is less likely to step on the bottom wall 52 than if it were formed in the manner of the valley strip 28. Moreover, the recessed bottom wall 52 is positioned more closely adjacent to the underlying roof structure, which may include the covering 40 and the underlying valley strip 28, which are in closer proximity to the bottom wall 52 than would be the case if the valley strip were formed in a conventional manner.

In finishing the roof surface 12 having the secondary covering 42, the shingle surface is cut along opposing edges 60 and 62 directly adjacent the sidewalls 54 and 56 to substantially effect a continuation of the sidewalls and thereby deepen the recess formed by the channel portion 46. This arrangement also helps in minimizing the cross-flow or upward flow of precipitation runoff from one roof surface to the other.

As will be appreciated from the foregoing description, the defined channel portion 46 is particularly advantageous for conducting a larger flow volume of water runoff without the risk of runoff flowing between the underside of the roof covering 42 and the valley strip flanges 48 and 50. Moreover, the channel shaped valley strip 44 provides a more pleasing appearance than prior art valleys for pitched roof structures.

Referring now to FIGS. 4, 5 and 6, there are illustrated sequential views of one method of forming the upper end of the valley strip 44 at the point of intersection of the valley strip with the ridge line formed by the intersection of the roof surfaces 14 and 16. In order to assure that runoff will not migrate under the bottom wall 52 of the channel portion 46, it is preferable to provide the valley strip 44 of a length sufficient that the bottom wall 52 extends over the ridge line and can be bent down onto opposing roof surface such as the surface 16, for example. In order to facilitate the bending process, it is preferable to form a cut at the intersection of the flanges 48 and 50 with their respective contiguous sidewalls 54 and 56, the respective cuts being indicated in FIG. 4 by the numerals 70 and 72. The cuts 70 and 72 may be made approximately two to six inches in length and followed by a folding operation wherein the sidewalls 54 and 56 are folded toward each other and down on top of the bottom wall 52 as illustrated in FIG. 5. Accordingly, the channel portion 46 is blended out into a relatively flat surface of the valley strip at the ridge line 18. The cuts 70 and 72 facilitate the bending operation without causing the flanges 48 and 50 to gather or pucker in a manner which would cause a hump or uneven surface for the ridge row shingles 19 illustrated in FIG. 1.

After forming the blended or faired end of the channel portion 46, as shown in FIG. 5, the distal end of the valley strip 44 may be folded over the ridge line 18 as illustrated in FIG. 6. Portions of the ends of the flanges 48 and 50 may be cut away as desired to accommodate the particular type of roof intersection, for example, the portion 51 of the flange 50 between the end of the valley strip and the cut line 53, illustrated in FIG. 6, may be cut away to provide a smoother surface for laying the ridge row of shingles over the end of the valley strip. If the roof surfaces intersect at the same level, the flange 48 may be left as illustrated in FIG. 6. However, if the roof surfaces intersect at different elevations as shown, for example, in FIG. 1, end portions of the flange 48 may also be cut away to reduce the amount of material that must be bent or otherwise contended with.

If the roof surfaces intersect in the manner shown for the roof of the house 10, a second valley strip 45 of identical construction will be preferably used to form the valley between the roof surfaces 12 and 16. In such an event, the valley strip 45 is laid over the top of the valley strip 44 sufficiently to provide for bending the end of the bottom wall 52 over the ridge line 18. The approximate relative positions of the valley strips 44 and 45 are illustrated in FIG. 6 prior to bending the end of the valley strip 45 over the ridge line. By cutting the ends of the valley strip at the lines of intersection of the sidewalls with the strip flanges and folding the end of the channel portion over the ridge line, not only is a smooth transition from the maximum depth of the channel portion 46 provided, but any forced upward flow of runoff resulting from heavy rains or high winds, for example, will pass over the ridge line and under the ridge row of shingles 19 and down the opposite roof surface without running under the valley strip itself.

It will be apparent from the foregoing description that the provision of a valley strip in accordance with the present invention provides an improvement in roof structures of various types including the type generally described herein in conjunction with the drawing figures. The preferred method of installation of the valley strip is believed to be readily apparent from the foregoing description. The valley strip is, of course, laid in place and the flanges 48 and 50 may be nailed with conventional roofing nails at suitable intervals to secure the valley strip to the underlying roof covering and/or the stringers 22. The valley strip may be installed over a subcovering such as the felt layer 40 or directly over the first roof covering 26. Moreover, the valley strip 44 can also be used in new roof construction by providing a suitable layer of shimming or decking under the flanges 48 and 50. For example, if a new roof is constructed with solid decking, the decking may be cut along an edge at approximately the positions of the edges 30 and 32 for the roof covering 26 to accommodate the channel portion 46 of the valley strip.

Those skilled in the art will appreciate from the foregoing description that an improved roof structure and valley strip is provided in accordance with the present invention. Moreover, various substitutions and modifications may be made to the particular embodiment described herein without departing from the scope of the invention as recited in the appended claims.

What is claimed is:

1. In a roof structure including at least two sloping roof surfaces intersecting at an angle to form a valley, said roof structure including a first roof covering on said roof surfaces, each of said first roof coverings being formed with adjacent spaced apart parallel edges, a second roof covering overlying said first roof covering and including a valley strip being defined by an elongated sheet member having a channel portion formed by a flat bottom wall and two spaced apart sidewalls extending substantially vertically upward from said bottom wall, opposed flange portions of said valley strip extending from said sidewalls and underlying said second roof covering on said roof surfaces, respectively, said valley strip extending to a ridge formed by the intersection of at least one of said roof surfaces with an opposed roof surface, said bottom wall of said valley strip extending over said ridge and at least partially along said opposed roof surface, and the depth of said channel portion being reduced at said ridge by said sidewalls being folded toward each other to overlie said bottom wall to flatten said valley strip at said ridge.

2. The roof structure set forth in claim 1 wherein:
said channel portion of said valley strip is interposed between said edges of said first roof covering whereby said bottom wall is recessed below the upper surface of said first covering.

3. The roof structure set forth in claim 2 wherein:
said second roof covering is formed to extend over said flange portions to about the edges of said flange portions formed by the intersection of said flange portions with said sidewalls, respectively.

4. The roof structure set forth in claim 1 wherein:
said valley strip is cut along the intersection of said sidewalls with said flange portions, respectively, at the end of said valley strip extending to said ridge.

5. The roof structure set forth in claim 4 wherein:
the end of at least one flange portion is folded over the adjacent sidewall along said cut.

6. A valley strip in a roof structure including at least two sloping roof surfaces intersecting at an angle forming a valley, said roof structure including respective first roof coverings on said roof surfaces, each of said first roof coverings being formed with adjacent spaced apart parallel edges, valley means covering said roof between said edges, and a second roof covering overlying said first roof covering, said valley strip comprising:
an elongated one piece sheet member having a channel portion formed by a bottom wall, two spaced apart sidewalls extending substantially perpendicular upward from said bottom wall, and opposed flange portions of said valley strip extending from said sidewalls for underlying said second roof covering on said roof surfaces, respectively, said valley strip of a length sufficient to extend along substantially the entire length of said valley to a ridge formed by the intersection of at least one of said roof surfaces with an opposed roof surface, and the depth of said channel portion being blended out at said ridge by said sidewalls being folded toward each other to overlie said bottom wall and to flatten said valley strip at said ridge.

* * * * *